United States Patent [19]

Gregory

[11] Patent Number: 4,949,551

[45] Date of Patent: Aug. 21, 1990

[54] HOT GAS DEFROST SYSTEM FOR REFRIGERATION SYSTEMS

[76] Inventor: Charles Gregory, 1348 5 Highway, Burlington, Ontario, Canada, L7R 3X4

[21] Appl. No.: 306,353

[22] Filed: Feb. 6, 1989

[51] Int. Cl.[5] ..... F25D 21/06

[52] U.S. Cl. ..... 62/196.4; 62/155; 62/278

[58] Field of Search ..... 62/278, 196.4, 81, DIG. 17, 62/155, 234

[56] References Cited

U.S. PATENT DOCUMENTS

| | | | |
|---|---|---|---|
| 3,464,226 | 9/1969 | Kramer | 62/278 X |
| 3,905,202 | 9/1975 | Taft et al. | 62/196.4 X |
| 4,193,781 | 3/1980 | Vogel et al. | 62/81 |

*Primary Examiner*—Harry B. Tanner
*Attorney, Agent, or Firm*—Rogers & Scott

[57] ABSTRACT

The invention provides a refrigeration system employing hot compressed gas from the compressor to defrost the cooling coil or coils. In prior systems this is accomplished by diverting part of the hot compressed gas to flow through the cooling coil, while the remainder continues to flow through the condensing coil to avoid overload of the compressor. It is found that as the ambient temperature of the condenser coil decreases the compressor output pressure also decreases, decreasing the amount of hot gas available for defrost, so that the period required for adequate defrost also varies. It is therefore necessary either to adjust the length of the defrost period with this ambient temperature, or make the period sufficiently long to ensure defrost at all times, the latter resulting in inefficient operation. In accordance with the invention, during a defrost period, upon detection of a lower predetermined pressure at the condenser coil outlet, a valve at the compressor outlet is operated to bypass the condenser coil and deliver hot compressed refrigerant directly to the liquid collector (which may be the liquid line) through a check valve that prevents delivery of refrigerant to the condensor coil and return of refrigerant from the collector to the condenser coil. If the pressure detected reaches a higher predetermined value, indicating that the compressor is becoming overloaded, the valve returns to delivering the refrigerant to the condenser coil until the pressure drops again to the lower value.

8 Claims, 2 Drawing Sheets

HOT GAS DEFROST SYSTEM FOR REFRIGERATION SYSTEMS

FIELD OF THE INVENTION

This invention is concerned with improvements in or relating to refrigeration systems, and especially to hot gas defrost systems for refrigeration systems and to apparatus for use in such systems

REVIEW OF THE PRIOR ART

The cooling coil of any refrigeration system will gradually collect frost or ice on its surface, due to condensation of water vapour from the air in contact with the coil, and its temperature is usually low enough for the moisture to freeze on it. Ice is a relatively good heat insulator and if allowed to build up will initially lower the efficiency of the refrigerator, and eventually cause it to become ineffective. The situation is more extreme in large commercial installations in which the ambient air is force circulated over the cooling coil or coils by a fan, because of the larger volumes of air which contact the coil.

It is standard practice therefore in all but the simplest refrigerator or refrigerator installation to provide a system for automatically defrosting the coil, usually by arranging that at controlled intervals it is warmed to a temperature and for a period that will melt the ice, the resultant water being drained away. There are two principal methods currently in use for automatic defrost, namely electrical and hot gas.

In an electrical defrost system electric heating elements are provided in contact with the coil; at the required intervals the refrigeration system is stopped from operating and the elements are switched on to provide the necessary heat. In a hot gas defrost system some of the hot gas delivered from the compressor, that normally goes to an exterior condensing coil to be cooled, is instead diverted into the cooling coil, again for a predetermined period found from experience to be satisfactory for the purpose. Both systems have their advantages and disadvantages.

An electrical system is relatively easy to design and install, but is more costly to implement and much less energy efficient than a hot gas system. Although a hot gas system is less costly to install it has been difficult to design, a particular problem being that the compressor, the most expensive single component of the system, is easily damaged if it receives liquid refrigerant instead of gaseous refrigerant at its inlet. The heat exchange between the hot gas and the cold ice-laden cooling coil will tend to liquefy at least some of the refrigerant, and the resultant droplets are difficult to remove from the remaining gas, with consequent danger to the compressor. A hot gas system delivers the heat directly inside the coil and can therefore perform a comparable defrost with less energy expenditure than an equivalent electrical system. Moreover, the hot gas system effectively obtains its power from the compressor motor and requires only the addition of suitable flow valves and piping for its implementation; it is therefore the preferred system provided one is able to ensure that the expensive compressor is not damaged by liquid refrigerant.

Another problem with hot gas systems is the difficulty that the defrosting cools the circulating vapour to produce some liquid, reducing the quantity of vapour available to the compressor to keep it operating efficiently. In commercial installations the usual solution is to employ multiple evaporator coils and to defrost them one at a time, so that the other coils can maintain the vapour supply at a suitable level; this requires somewhat complex valving to achieve.

It is conventional practice therefore to employ at least three separate coils, since it is considered that there is too much danger with only two coils of "running out of heat", so that the compressor does not receive sufficient vapour to operate. Some commercial installations use even more than three coils to ensure that this type of failure cannot happen, but this increases the overall complexity of the system and also increases the number of defrost periods required, so that in a retail store installation it becomes difficult to schedule the defrost outside the peak shopping periods. There is a tendency in commercial supermarket practice to use small multiple installations instead of large central units, and these become expensive if multiple coils are required for defrost purposes.

Electrical defrost is relatively expensive in operation for commercial purposes, although acceptable for domestic refrigerators, which are almost universally single coil, for want of a more efficient system. There has been reluctance to apply hot gas defrost to a single coil refrigerator because of the difficulty of avoiding running out of vapour, or the alternative difficulty if the fluid from the cooling coil is heated, for example by a heat exchanger, of ensuring that the compressor does not become overheated because the gas fed to its inlet becomes too hot.

One special group of systems in which defrost is a particular problem are those used on smaller transport trucks, since they must be able to operate alternatively from the truck engine while it is travelling, and from an electric plug-in point while stationary in the garage with the engine stopped. A hot gas defrost would be most satisfactory, but requires a complex reverse cycle and the majority of systems opt for an electric defrost while plugged in, the icing that occurs during running being accepted as unavoidable.

As an example of the energy required to operate an electrical defrost system in a commercial "cold room" intended for the storage of frozen meat at about −23° C. (−10° F.), a system employing a motor of 5 horsepower requires electric heating elements totalling 6,000 watts to satisfactorily defrost the coil, employing a heating cycle of four periods per day, each of 45 minutes duration. The daily consumption of defrost energy is therefore 18 kWH. This heat is injected into the room and must subsequently be removed by the system, adding to the cost of operation. The transfer of heat from the electric elements to the coil is not very efficient and in many systems it is found that during the defrost period the temperature in the cooled space rises from the nominal value to as high as 0° C. (32° F.), and this is high enough to cause thermal shock to some products, such as ice cream. Moreover, unsophisticated users of the system may be disturbed to find during a defrost period that the "cold" room is unexpectedly warm and conclude that the system is faulty, leading to an unnecessary service call.

Hot gas defrost systems for refrigeration systems and refrigeration systems employing such hot gas defrost systems are described and claimed in my prior U.S. Pat. Nos. 4,798,058 and 4,802,339, and U.S. application Nos. 07/205,773 and 07/268,412, the disclosures of which are incorporated herein by this reference. These systems employ new full flow liquid refrigerant vaporizers using the hot gas, which are able to effectively vaporize any liquid from the cooling coil or coils, while not having any appreciable effect on the flow characteristics of the system while not in operation. These systems have proven to be very effective but it has been observed with these systems, and with other prior art systems, that the defrost capacity decreases as the ambient temperature around the condenser coil decreases, with corresponding increase in the length of the defrost cycle required, and vice versa. This is inconvenient since the defrost period must then be set to a minimum to ensure that adequate defrost occurs at the lower temperatures normally encountered, with the result that for much of the time the period is too long and energy is wasted. A solution would be to arrange that the defrost period is adjusted manually or automatically in accordance with this ambient temperature, but this involves either the more-or-less constant attention of an operator, or the use of an expensive programmable control.

DEFINITION OF THE INVENTION

It is therefore an object of the present invention to provide a refrigeration system comprising a new hot gas defrost system with which a defrost period can be obtained that is less dependent than hitherto on variations in the ambient temperature around the condenser coil or coils.

In accordance with the present invention there is provided a refrigeration system comprising:

a refrigerant compressor having an inlet for refrigerant to be compressed and an outlet for hot compressed refrigerant;

a condensing coil having an inlet and an outlet, the coil receiving at its inlet the compressed refrigerant from the compressor outlet and cooling it to produce at its outlet cooled compressed refrigerant;

a liquid refrigerant receiver having an inlet and an outlet and having its inlet connected to the condensing coil outlet to receive cooled compressed refrigerant therefrom;

at least one cooling coil having an inlet and an outlet;

an expansion device for expanding and cooling refrigerant connected between the receiver outlet and the cooling coil inlet and delivering expanded refrigerant to the cooling coil;

a controllable defrost control valve connected between the compressor outlet and the cooling coil inlet and operable during a defrost period to deliver hot compressed refrigerant to the cooling coil for defrost thereof;

transfer valve means connected to the compressor outlet, the condensing coil inlet and the receiver inlet and operable during a defrost period to deliver hot compressed refrigerant for the condensing coil inlet to the condensing coil inlet a or to the receiver inlet; or both, through a check valve that prevents delivery of refrigerant to the condensor coil and return of refrigerant from the collector to the condensor coil.

and pressure sensing means sensing the refrigerant pressure at or adjacent the receiver inlet;

the transfer valve means being operable during a defrost period in response to detection of a predetermined lower pressure by the pressure sensing means to deliver at least some of the hot compressed refrigerant through the transfer valve means to the liquid receiver inlet instead of to the condensing coil, inlet and being operable in response to detection of a predetermined higher pressure to deliver the hot compressed gas through the transfer valve means to the condensing coil inlet instead of to the receiver inlet.

Also in accordance with the invention there is provided a refrigeration system comprising:

a refrigerant compressor having an inlet for refrigerant to be compressed and an outlet for hot compressed refrigerant;

a condensing coil having an inlet and an outlet, the coil receiving at its inlet the compressed refrigerant from the compressor outlet and cooling it to produce at its outlet cooled compressed refrigerant;

a liquid line having an inlet and an outlet and having its inlet connected to the condensing coil outlet to receive cooled compressed refrigerant therefrom;

at least one cooling coil having an inlet and an outlet;

an expansion device for expanding and cooling refrigerant connected between the liquid line outlet and the cooling coil inlet and delivering expanded refrigerant to the cooling coil;

a controllable defrost control valve connected between the compressor outlet and the cooling coil inlet and operable during a defrost period to deliver hot compressed refrigerant to the cooling coil for defrost thereof;

transfer valve means connected to the compressor outlet, the condensing coil inlet and the liquid line inlet and operable during a defrost period to deliver hot compressed refrigerant for the condensing coil inlet a to the condensing coil inlet, or both or to the liquid line inlet;

one way valve means connected at the condensing coil outlet and preventing entry thereto of refrigerant from the compressor and return thereto of refrigerant from the receiver inlet;

and pressure sensing means sensing the refrigerant pressure at or adjacent the liquid line inlet;

the transfer valve means being operable during a defrost period in response to detection of a predetermined lower pressure by the pressure sensing means to deliver at least some of the hot compressed refrigerant through the valve means to the liquid line inlet instead of to the condensing coil, inlet and being operable in response to detection of a predetermined higher pressure to deliver the hot compressed gas through the transfer valve means to the condensing coil inlet instead of to the liquid line.

DESCRIPTION OF THE DRAWINGS

Embodiments of the invention will now be described, by way of example, with reference to the accompanying schematic and diagrammatic drawings, wherein.

DESCRIPTION OF THE PREFERRED EMBODIMENTS

Figure 1:
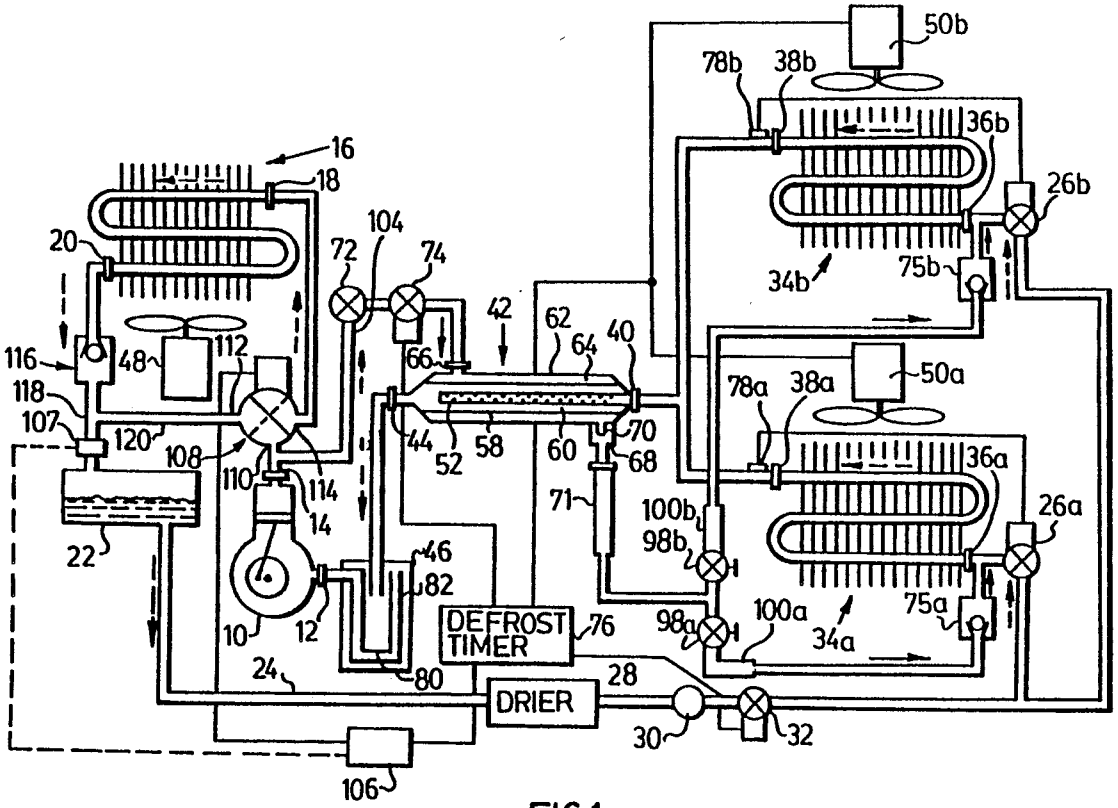
FIG. 1 is a schematic diagram of a first refrigeration system embodying the invention.

FIG. 1 shows a refrigeration system which includes a compressor 10 having a suction inlet 12 and a high pressure outlet 14. A refrigerant condenser coil 16 has an inlet 18 connected to the outlet 14 via an electricallyoperated three-way transfer valve 108 having an inlet 110 and alternative outlets 112 and 114, whose function will be described below, while the coil outlet 20 is connected through a check valve 116 to the inlet of the usual liquid refrigerant collector vessel 22. A connector pipe 120 is provided between the valve outlet 112 and a T-junction 118 interposed between the check valve 116 and collector vessel 22. A refrigerant-conducting line 24 connects the outlet of the vessel 22 to a thermostatic expansion valve 26 through a filter drier 28, a liquid indicator 30 and a solenoid-controlled valve 32. The system illustrated is of multiple evaporator type having two evaporator coils 34a and 34b, and similar elements required for each evaporator coil are given the same reference number with the respective subscript a or b. The invention is also applicable to single evaporator coil systems, while it is usual in commercial installations for many more than two evaporator coils to be employed, and installations with as many as 16 separate evaporator coils are not unusual. Each cooling coil 34a or 34b has an inlet 36a or 36b connected to a respective expansion valve 26a or 26b, and an outlet 38a or 38b connected to a refrigerant inlet 40 of a full flow liquid refrigerant vaporizer indicated generally by 42. The vaporizer 42 has an outlet 44 connected to the inlet of a suction line liquid accumulator 46, while the outlet of the accumulator 46 is connected to the suction inlet 12 of the compressor 10.

In its usual refrigeration mode of operation hot compressed gas from the compressor is condensed in the condensing coil 16, a fan 48 being provided to circulate air over and through the finned heat exchange structure of the coil. With the expansion valves 26a, 26b and control valve 32 open liquid refrigerant expands in the expansion valves and passes into the respective coil to cool it, air in the adjacent space being circulated over each coil by a respective fan 50a or 50b. All the expanded refrigerant vapour from the cooling coils passes through the vaporizer 42, whose structure and function will be described below, to return to the compressor 10 via a liquid accumulator 46. This is of course the standard mode of operation for a refrigeration system, and this particular flow is illustrated by the broken line arrows.

The vaporizer 42 includes a first inner pipe 52 having a plurality of holes 56 distributed uniformly along it and around its circumference. A second middle pipe 58 surrounds the pipe 52 to form between itself and the pipe 52 a second annular middle chamber 60, the pipe 58 being made of a suitable heat-conductive material, for example copper, brass or the like. A third outermost pipe 62 encloses the pipe 58 and is sealed to it so as to define a third outer annular cross-section chamber 64. A hot gas inlet 66 is provided at one end of pipe 62 and an outlet 68 at the other end, so that refrigerant fluid can be passed through the chamber 64 in contact with the outer wall of the heat-conductive pipe 58 and countercurrent to the flow of refrigerant in the pipe 58. The outlet 68 of the vaporizer is provided downstream with a fixed restriction 70 of predetermined smaller size and an expansion chamber 71. The function and mode of operation of the vaporizer 42 are fully described in my U.S. Patents and applications referred to above, to which reference may be made for detailed explanation. The vaporizer inlet 66 is connected to the compressor outlet 14 via a control valve 72 and a hot gas solenoid-operated valve 74, while its outlet 68 is connected via the expansion chamber 71, respective optional adjustable restrictors 98a and 98b, respective optional downstream expansion chambers 100a and 100b, and respective check valves 75a and 75b to the junction of each cooling coil inlet 36a and 36 and expansion valve 26a or 26b.

The operation of the defrost system is under the control of a defrost timer 76 connected to the fan 50 and to the valves 32 and 74. The operation of each expansion valve 26a or 26b is under the control of a respective thermostatic sensor 78a or 78b. The operation of the transfer valve 108 is controlled by a control 106, which is connected to the defrost timer so as to be effective only during the defrost cycle, at which time the control 106 operates the valve 108 in accordance with the refrigerant fluid pressure at the connection between condenser coil outlet 20 and the inlet to collector vessel 22, as determined by a pressure sensor 107. In the normal refrigeration cycle the solenoid of valve 108 is de-energized and the valve is then in the position illustrated by a broken line in which the outlet 114 is open to the inlet 110, while the outlet 112 is closed; at this time the hot gas solenoid valve 74 is closed and the hot gas is fed only to the condenser coil 16. The remainder of the controls that are required for operation of the system will be apparent to those skilled in the art and do not require description herein.

At predetermined intervals the defrost timer 76 initiates a defrost cycle by closing the solenoid valve 32 so that expanded cold refrigerant is no longer supplied to the coils 34a and 34b; the timer also de-energizes the fans 50a and 50b and opens hot gas solenoid valve 74, whereupon the heated vapour from the compressor flows through the outer annular chamber 64 of the vaporizer 42 and heats the conductive pipe 58. The fluid exits at outlet 68 through the restriction 70 and the expansion chamber 71 and passes through the respective controllable restriction 98a or 98b, the respective expansion chamber 100a or 100b, and the respective check valve 75a or 75b to enter the respective coil 34a or 34b. The vapour gives up sensible and latent heat to the coil, warming it and melting any frost and ice accumulation, becoming cooler by the consequent heat exchange; the vapour moves through the coil at relatively high velocity and only part of it condenses to liquid.

The high velocity fluid from the cooling coils with its entrained liquid enters the pipe 52 and becomes turbulent, the resulting turbulent mist being discharged forcefully through the holes 56 into intimate contact with the whole length of the hot inner wall of the pipe 58, resulting in complete and substantially immediate evaporation of the fine droplets. The fluid in the chamber 60, consisting now entirely of vapour, exits through outlet 44 and the accumulator 46 to the compressor inlet 12. As is usual, any lubricant in the system that collects in the accumulator bleeds back into the circuit through bleed hole 80 in return pipe 82. At the end of the timed defrost period the timer 76 deenergizes and closes the hot gas valve 74, opens valve 32 and re-energizes the fan motor 50, so that the system is again in its normal cooling mode.

During the defrost cycle in prior art systems the compressor continues to supply hot gas to the condenser coil 16, and this has been considered to be necessary to avoid throttling the compressor if it supplies only the evaporator coils, with possible consequent overload of the compressor motor. It has been found as a result that the defrost capacity of the defrost system decreases as the ambient temperature of the condenser coil decreases and it condenses the hot gas faster, decreasing the compressor output pressure and correspondingly the amount and pressure of the gas available for defrost. To compensate for this either the length of the defrost period must be varied in accordance with this ambient temperature, or the period must be made so long that defrost is always obtained at the lowest ambient temperature likely to be encountered by the condenser coil, when it will be too long for most of its operation with consequent inefficient operation. One solution to this problem would be to control the length of the defrost period using a programmable control supplied with a signal corresponding to the condenser coil ambient temperature, provided from a temperature sensor closely adjacent the coil, but this is not as satisfactory as a constant defrost period of as short a duration as possible, such as can be obtained with the system of this invention.

As described above the valve 108 is normally in the position shown in broken line and cannot be moved from this position until the defrost timer 76 enables the control 106. If upon initiation of the defrost cycle the condenser coil outlet temperature is sufficiently high the refrigerant pressure measured by the sensor 107 at the inlet of the collector 22 will be above a predetermined higher value, indicating that there is adequate hot gas for defrost of the evaporator coils. In this case the control 106 does not operate and the valve 108 remains in its unactivated condition. If however the pressure measured by the sensor 107 is below a predetermined lower value, indicating that the supply of gas is insufficient, the control 106 closes to actuate the valve 108, whereupon it moves to the position shown in solid line in which the inlet 110 and outlet 112 are connected. The hot fluid now by-passes the condenser coil 16 and flows directly to the top of the liquid receiver, the liquid refrigerant in the receiver acting as a pressure stabilizer, by acting as a supply source of refrigerant vapour, to maintain this higher pressure without excessive overloading of the compressor output. The check valve 116 prevents the pressurized refrigerant from entering eh condenser coil outlet 20, so that it must pass to the receiver and cannot return from the receiver to the condenser coil. The receiver normally is located in the warm compressor room and even in winter will be at a temperature in the range (60° F.–70° F.), as compared to the much lower ambient temperature at the outdoor condenser coil. Instead of a variable proportion of the hot gas being delivered to the condenser coil, while whatever remains is delivered to the evaporator coils via the closed circuit including the vaporizer 42, all of the hot gas is now delivered to the evaporator coils. Thus, all of the energy imparted by the compressor to the gas is delivered to the evaporator coils for use in defrost.

If the pressure detected by sensor 107 increases beyond the predetermined higher value, indicating that the compressor is being loaded excessively, the control 106 operates to de-energize the solenoid valve 108 and return it to the position for the hot gas to flow again into the condenser coil to reduce the pressure to a suitable value. The liquid receiver provides the capacity necessary to ensure that the system, and particularly the valve 108, will not cycle excessively between these two conditions. In defrost mode therefore the defrost gas pressure remains relatively constant between the upper and lower values at which the control 106 operates, and the defrost timer 76 can therefore be set for a fixed time period with the knowledge that defrost will always be obtained with that period, and without the inefficiency caused by an excessively long defrost period.

Some systems are not provided with a receiver 22 in the form of a separate tank and instead rely upon the capacity of the condenser coil to provide a source of liquid refrigerant during normal operation; such a system may therefore require the addition of a receiver. However, some systems not having a receiver operate using the liquid line 24 as the vapour source and if this has sufficient capacity to constitute the receiver required for satisfactory operation a separate receiver may not be required.

Some systems, in order to maintain adequate lead pressure at the condenser outlet 20, are provided with a hold-back valve (not shown) at the outlet which causes the condenser coil to flood with liquid refrigerant, thus reducing its capacity. Moreover, in some systems in order to maintain adequate pressure and temperature in the receiver a by-pass line (not shown) is permanently connected from the compressor outlet 14 through a pre-loaded check valve (not shown) to the inlet of the receiver, the check valve being operative, e.g. with a 1.4 Kg.sq.cm. (20 p.s.i.) differential, so that when the pressure in the receiver drops below the compressor discharge pressure by more than the preset differential it opens and maintains it at the said adequate pressure, etc.

In this embodiment the valve 108 operates to deliver hot compressed fluid from the compressor alternatively to the condenser coil or to the liquid collector, and this simple arrangement has been found to be highly satisfactory. For example, upon its installation in a system which previously required adjustment of the defrost time from 30 to 70 minutes it was found possible to stabilize the defrost time at about 30 minutes with adequate defrost always being obtained. In this system, which was of 20 h.p. capacity using R22 refrigerant, the control circuit was adjusted to operate the valve 108 at a higher pressure of 17.5 Kg.sq.cm. (250 p.s.i.) and a lower pressure of 14.7 Kg.sq.cm. (210 p.s.i.). In an alternative embodiment for which FIG. 1 also serves as an illustration the valve 108 is a modulating valve which progressively changes the feed of the hot compressed gas from the condenser coil only to the liquid collector only under supervision of the control 106, instead of in an on/off mode, so that for much of the operation of the valve the gas may be fed to both. With such an arrangement the pressure as measured by transducer 107 can be held within a much narrower range; however such a valve and control is more costly in installation and likely to be more costly in maintainance cost.

The fixed restrictor 70 and controllable restrictors **98*a* and 98*b* increase the discharge pressure of the compressor resulting in a higher temperature and greater density of the fluid fed to the chamber 64, and consequently resulting in a fluid of higher energy content that ensures adequate heating of the wall of the pipe 58 despite the speed at which the gas flows through the vaporizer. Another effect is to increase the velocity of the flow through the evaporator coils to ensure that at all times, even at the start of the defrost cycle when the coils are particularly cold, there will only be partial condensation of the refrigerant to liquid, and forceful passage of the resultant mist through the vaporizer. Maintenance of this velocity is also facilitated by the expansion chambers 71, 100*a* and 100*b*** which provide enlarged spaces immediately following the respective restrictor in which any residual liquid can expand to the vapour state. For further description of the functions and modes of operation of the restrictors and expansion chambers reference may be made to my U.S. Pat. No. 4,802,339 and application No. 07/205,773.

Figure 2:
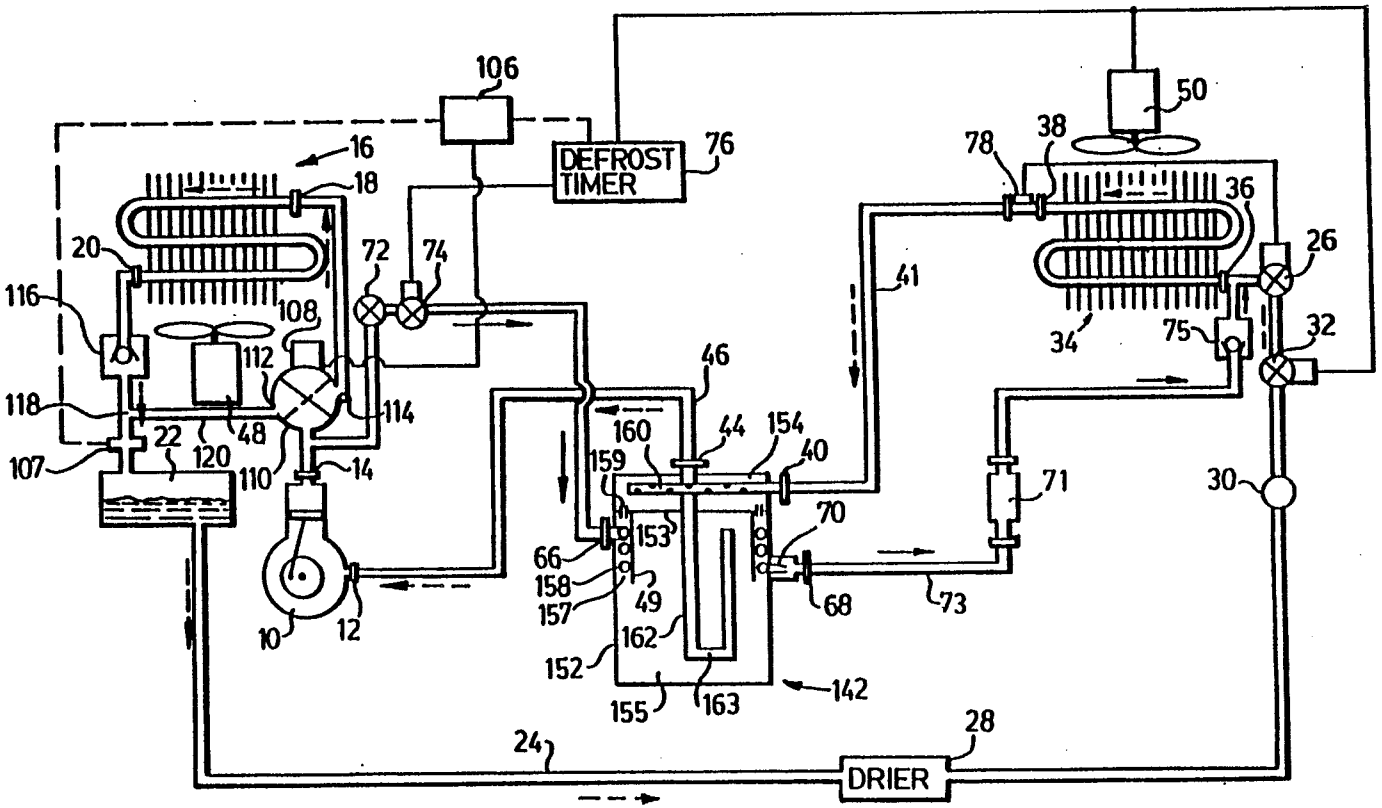
FIG. 2 is a similar diagram of a second system embodying the invention.

FIG. 2 shows the application of the invention to the system described and claimed in my patent application No. 07/268,412, in which the accumulator 46 also provides an vaporizer function in place of the vaporizer 42 of the system of FIG. 1. The modes of operation of the two systems in accordance with the invention are identical and accordingly wherever possible the same components are given the same reference numbers, while equivalent components are given the same reference number plus 100.

In this embodiment the combined vaporizing accumulator 142 comprises an outer shell 152, usually of cylindrical form, divided by a transverse plate member 153 into a smaller upper chamber 154 and a larger lower chamber 155. A baffle extends downward from the underside of the plate 153 into the lower chamber, the baffle being spaced equidistantly around its circumference from the inner wall of the shell 152 to provide an annular space 157 in which is disposed a helical heat-exchange hot gas coil 158. The interiors of the two chambers communicate with one another by means of a plurality of bores or holes 159 in the plate member 153 arranged in a circle adjacent its outer circumference, these holes being centered above the hot gas coil 158. The suction inlet 40 is connected to a perforated closed-end pipe 160 mounted in the outer shell 152 and centered in the upper chamber 154. The pipe distributes the refrigerant throughout the chamber 154 in a turbulent flow, the turbulent vapor passing through the holes 159 into the space 157 where it impinges on the heated coil 158. The vaporized fluid passes through a conventional J-shaped outlet pipe 162 to the outlet 44, the pipe being provided with the usual drain hole 163. A hot gas outlet 68 at the other end of the coil 158 contains restriction 70.

I claim:

1. A refrigeration system comprising:

a refrigerant compressor having an inlet for refrigerant to be compressed and an outlet for hot compressed refrigerant;

a condensing coil having an inlet and an outlet, the coil receiving at its inlet the compressed refrigerant from the compressor outlet and cooling it to produce at its outlet cooled compressed refrigerant;

a liquid refrigerant receiver having an inlet and an outlet and having its inlet connected to the condensing coil outlet to receive cooled compressed refrigerant therefrom;

at least one cooling coil having an inlet and an outlet;

an expansion device for expanding and cooling refrigerant connected between the receiver outlet and the cooling coil inlet and delivering expanded refrigerant to the cooling coil;

a controllable defrost control valve connected between the compressor outlet and the cooling coil inlet and operable during a defrost period deliver hot compressed refrigerant to the cooling coil for defrost thereof;

transfer valve means connected to the compressor outlet, the condensing oil inlet and the receiver inlet and operable during a defrost period to deliver hot compressed refrigerant for the condensing coil inlet to the condensing coil inlet, or to the receiver inlet, or to both;

one way valve means connected at the condensing coil outlet and preventing entry of refrigerant thereto from the compressor and return thereto of refrigerant from the receiver inlet;

and pressure sensing means sensing the refrigerant pressure at or adjacent the receiver inlet;

the transfer valve means being operable during a defrost period in response to detection of a predetermined lower pressure by the pressure sensing means to deliver at least some of the hot compressed refrigerant through the transfer valve means to the liquid receiver inlet instead of to the condensing coil inlet, and being operable in response to detection of a predetermined higher pressure to deliver the hot compressed gas through the transfer valve means to the condensing coil inlet instead of to the receiver inlet.

2. A system as claimed in claim 1, wherein the transfer valve means is operable during a defrost period in response to detection of the predetermined lower pressure to stop delivery of any hot compressed refrigerant to the condensing coil inlet.

3. A system as claimed in claim 2, wherein the transfer valve means comprises a three-way, solenoid-operated valve that when unenergized deliverers hot compressed refrigerant to the condensing coil inlet, and when energized delivers hot compressed refrigerant to the liquid receiver inlet.

4. A system as claimed in any one of claims 1 to 3, and comprising control means for controlling the transfer valve means, the control means being connected to the pressure sensing means and to the transfer valve means and controlling the transfer valve means in accordance with the pressure detected by the pressure sensing means;

the system including a defrost timer for timing the defrost periods for which hot compressed gas is delivered to the cooling coil for defrost thereof; and the control means being controlled by the defrost timer to be inoperative other than using a defrost period.

5. A refrigeration system comprising:

a refrigerant compressor having an inlet for refrigerant to be compressed and an outlet for hot compressed refrigerant;

a condensing coil having an inlet and an outlet, the coil receiving at its inlet the compressed refrigerant from the compressor outlet and cooling it to produce at its outlet cooled compressed refrigerant;

a liquid line having an inlet and an outlet and having its inlet connected to the condensing coil outlet to receive cooled compressed refrigerant therefrom;

at least one cooling coil having an inlet and an outlet;

an expansion device for expanding and cooling refrigerant connected between the liquid line outlet and the cooling coil inlet and delivering expanded refrigerant to the cooling coil;

a controllable defrost control valve connected between the compressor outlet and the cooling coil inlet and operable during a defrost period to deliver hot compressed refrigerant to the cooling coil for defrost thereof;

transfer valve means connected to the compressor outlet, the condensing coil inlet and the liquid line inlet and operable during a defrost period to deliver hot compressed refrigerant for the condensing coil inlet to the condensing coil inlet, or to the liquid line inlet, or to both;

one way valve means connected at the condensing coil outlet and preventing entry thereto of refrigerant from the compressor and return thereto of refrigerant from the receiver inlet;

and pressure sensing means sensing the refrigerant pressure at or adjacent the liquid line inlet;

the transfer valve means being operable during a defrost period in response to detection of a predetermined lower pressure by the pressure sensing means to deliver at least some of the hot compressed refrigerant through the transfer valve means to the liquid line inlet instead of to the condensing coil inlet, and being operable in response to detection of a predetermined higher pressure to deliver the hot compressed gas through the transfer valve means to the condensing coil inlet instead of to the liquid line inlet.

6. A system as claimed in claim 5, wherein the transfer valve means is operable during a defrost period in response tot detection of the predetermined lower pressure to stop delivery of any hot compressed refrigerant to the condensing coil inlet.

7. A system as claimed in claim 6, wherein the transfer valve means comprises a three-way, solenoid-operated valve that when unenergized delivers hot compressed refrigerant to the condensing coil inlet, and when energized delivers hot compressed refrigerant to the liquid line inlet.

8. A system as claimed in any one of claims 5 to 7, and comprising control means for controlling the transfer valve means, the control means being connected to the pressure sensing means and to the transfer valve means and controlling the transfer valve means in accordance with the pressure detected by the pressure sensing means;

the system including a defrost timer for timing the defrost periods for which hot compressed gas is delivered to the cooling coil for defrost thereof; and the control means being controlled by the defrost timer to be inoperative other than during a defrost period.

* * * * *